US005123653A

United States Patent [19]

Murphy et al.

[11] Patent Number: 5,123,653

[45] Date of Patent: Jun. 23, 1992

[54] BASKETBALL GAME BOARD APPARATUS

[76] Inventors: Gene Murphy, 410 Siebert St., Columbus, Ohio 43206; Robin R. Louderback, 203 Security Bldg., 100 Capitol St., Charleston, W. Va. 25301

[21] Appl. No.: 784,906

[22] Filed: Oct. 30, 1991

[51] Int. Cl.[5] ..... A63F 3/00; A63F 7/20; A63F 9/18

[52] U.S. Cl. ..... 273/244; 273/85 R; 273/431

[58] Field of Search ..... 273/244, 259, 277, 85 R, 273/85 E, 256, 430–432

[56] References Cited

U.S. PATENT DOCUMENTS

| | | | |
|---|---|---|---|
| 2,261,448 | 11/1941 | Petersen | 273/85 R |
| 3,689,069 | 9/1972 | Rogers | 273/85 R |
| 4,052,064 | 10/1977 | Kennoy | 273/85 R |
| 4,210,328 | 7/1980 | Meintzer et al. | 273/85 R |
| 4,449,711 | 5/1984 | Calloway | 273/256 |
| 4,856,780 | 8/1989 | Begley et al. | 273/244 |

FOREIGN PATENT DOCUMENTS

| | | | |
|---|---|---|---|
| 2573666 | 5/1986 | France | 273/244 |

*Primary Examiner*—Benjamin Layno
*Attorney, Agent, or Firm*—George J. Neilan

[57] ABSTRACT

A basketball game comprising a game board with a main section simulating a basketball court, a pathway of playing spaces around the periphery of the basketball court, a miniature basketball goal and basketball at each end of the court, at least one set of basketball information question and answer cards, a plurality of questions and answers on each card, indicia on the cards identifying the questions, and means to determine by chance which question to use during a given player turn. In one aspect of the invention, the goals are movable by chance to vary the distance of a shot at the goal. Points are scored by correctly answering questions and/or by making shots at the goals.

11 Claims, 2 Drawing Sheets

BASKETBALL GAME BOARD APPARATUS

BACKGROUND OF THE INVENTION

The present invention relates to game board apparatus for playing a basketball game which combines elements of chance, knowledge of basketball teams and players, and skill in shooting at a miniature basketball goal.

Board games are a popular recreational activity. There is considerable effort to develop games that will catch the public's attention.

One known board game, disclosed in U.S. Pat. No. 4,856,780 to Begley et al, relates to a game in which a player seeks to earn points by correctly answering basketball trivia questions. Marked playing squares determine the difficulty of the questions asked.

SUMMARY OF THE INVENTION

The primary object of the present invention is to provide a novel basketball game board apparatus. Another object of the invention is to provide a board game which requires players to actively participate by shooting at miniature goals, and also tests knowledge of basketball teams and players. Another object is to provide a board game in which the game board simulates a basketball court and the position of basketball goals is changed by chance to vary the distance of an attempted shot.

According to a presently preferred embodiment of the invention; the game board has a main section simulating a basketball court, and a plurality of playing spaces around the periphery of the basketball court. Movable basketball goals are located at opposite ends of the court. The court is divided into a plurality of zones which extend across the court. A die or the like determines which zone the goal is placed in and thus the distance of a shot at the goal is determined by chance. Points may be scored by making a shot. The playing spaces include grouped spaces marked with indicia corresponding to indicia identifying questions of different basketball topics on question and answer cards.

According to one one mode of play; after rolling the die, the goal is moved to the appropriate zone and a shot taken with a miniature basketball. If the shot is made, points are scored, and the player's token is moved about the playing spaces the number specified by the die. The player then attempts to answer a question determined by indicia on the space landed upon, and by corresponding indicia identifying questions on one of the question and answer cards. If the player answers correctly; he continues to play and rolls the die again. If the shot misses or if the question is not answered correctly; play passes to the next player.

In another mode of play, the goals stay at the ends of the court so that all shots are the same length. In this case, the die is rolled and the number rolled determines which question to ask from another set of cards. If answered correctly, points are scored and a shot at a goal is attempted. If the question is not answered correctly, no shot is taken and play proceeds to the next player. Points are awarded both for made shots and correct answers in this mode of play.

Other objects, features and advantages of the invention wll become more apparent as this description proceeds.

DETAILED DESCRIPTION OF THE INVENTION

Figure 1:
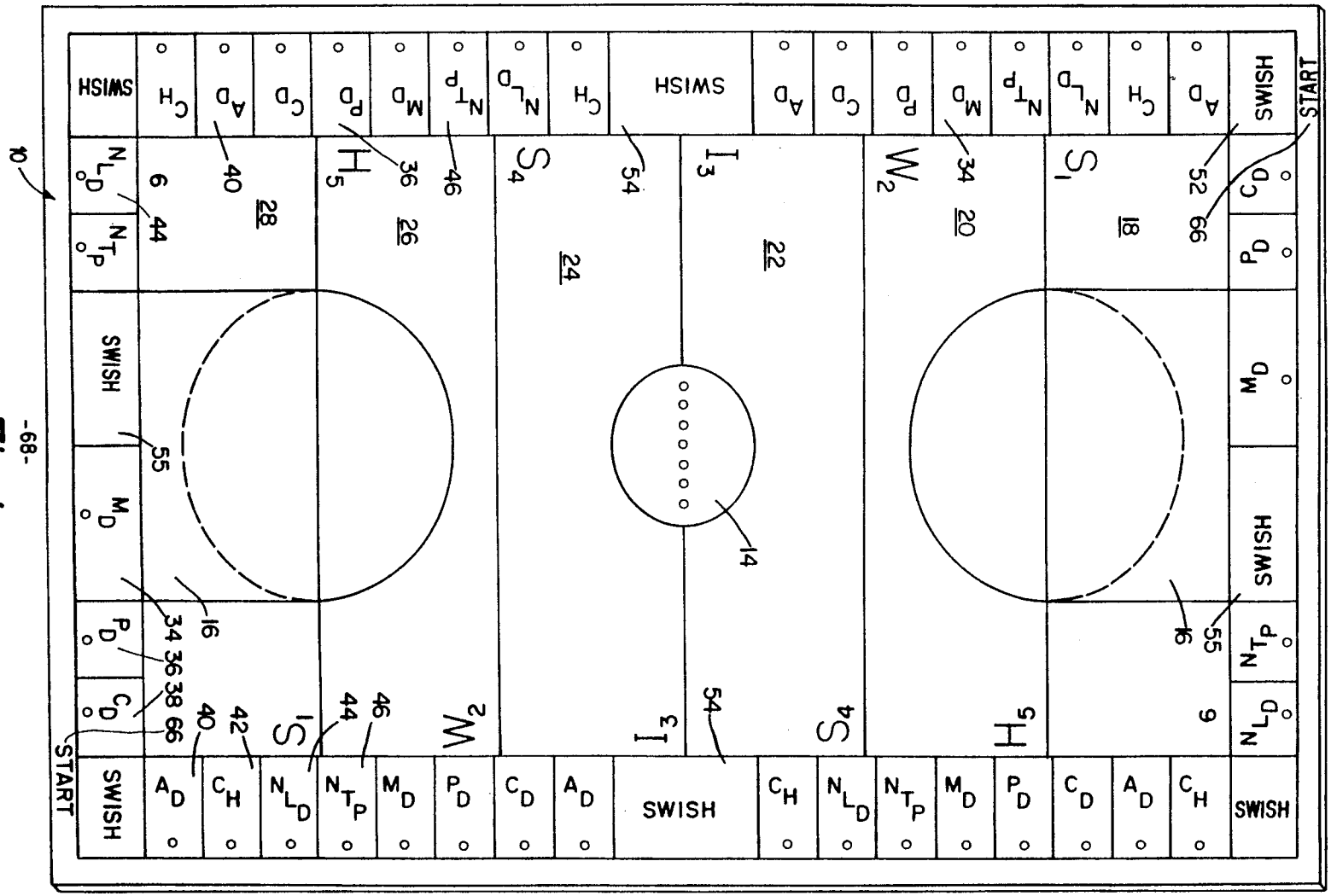
FIG. 1 is a plan view of a game board in accordance with a presently preferred embodiment of the present invention.
Figure 2:
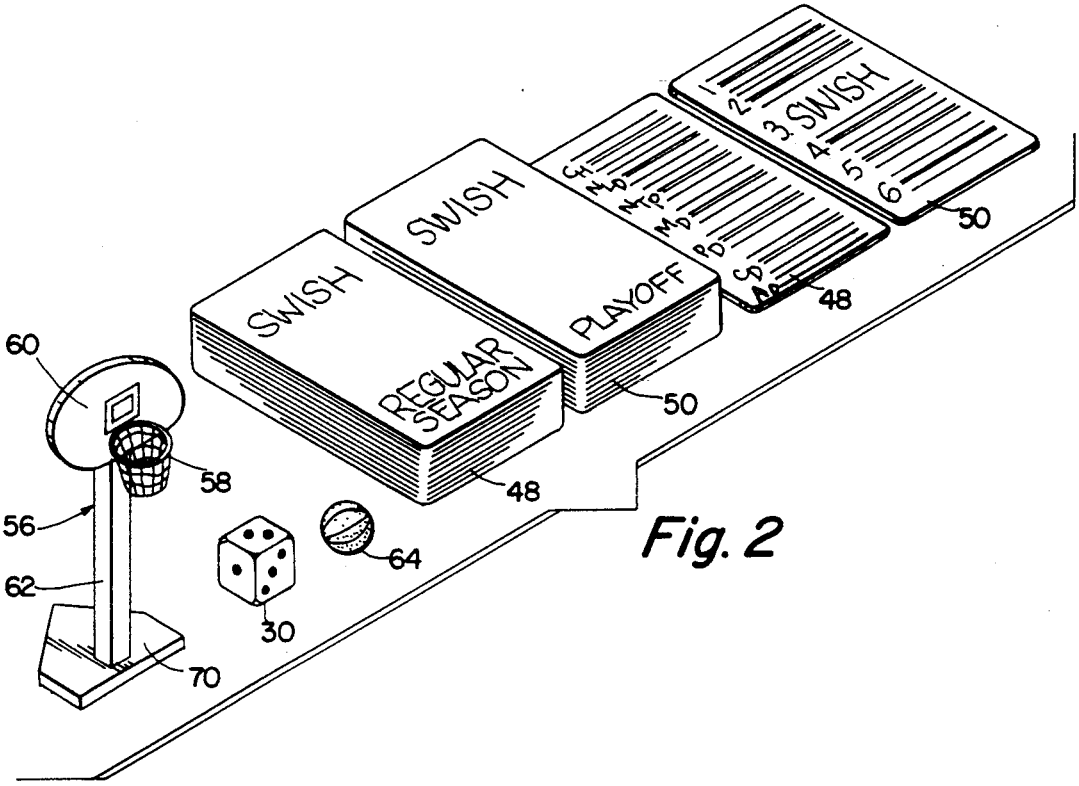
FIG. 2 is a perspective view of various items used with the game board of FIG. 1.

Referring to FIG. 1, reference numeral 10 generally designates a game board for carrying out a preferred embodiment of the invention. Game board 10 has a main section simulating a basketball court which includes a center jump 14, and free throw lanes 16 at opposite ends of the court. The basketball court is divided into six zones which extend across the court from one sideline to the other, and starting at the top of FIG. 1 are numbered in sequence 18, 20, 22, 24, 26, and 28. As viewed by a player at the bottom of FIG. 1; along the left side the zones each have in order one of the following indicia: $S_1$, $W_2$, $I_3$, $S_4$, $H_5$, and 6. The letters form the word SWISH which is a trademark for the subject board game. The numbers 1 to 6 correspond to the numbering on a die 30 (FIG. 2). The same indicia are printed along the right side of the zones 18 to 28; but in reverse order starting at zone 28 and going to zone 18, and the indicia are themselves reversed so as to be correctly positioned to be read by a player positioned at the far end of the court, i.e., the top of FIG. 1.

Figure 3:
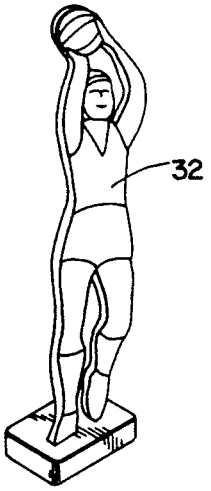
FIG. 3 is a perspective view of a player token used in carrying out the invention.

Around the periphery of the basketball court there are a plurality of playing spaces for receiving player tokens which move in a path around the board. A suitable token 32, which has the outline of a basketball player with a ball raised in shooting position, is shown in FIG. 3.

The playing spaces include sets of spaces 34, 36, 38, 40, 42, 44, and 46 arranged in counterclockwise order around the board, and marked with one of the following indicia: $M_D$, $P_D$, $C_D$, $A_D$, $C_H$, $N_{LD}$, and $N_{TP}$. These indicia have the following meanings: $M_D$—Midwest Division; $P_D$—Pacific Division; $C_D$—Central Division; $A_D$—Atlantic Division; $C_H$—College Highlights; $N_{LD}$—NBA Leaders and Deals; and $N_{TP}$—Name The Player. A set of regular season question and answer cards 48 (FIG. 2) contains cards that each have a plurality of questions and answers identified by the same indicia as are on the playing spaces, so that the playing space landed upon determines which question on a card is asked on a particular player turn.

The playing spaces also include eight spaces marked "SWISH", comprising four corner spaces 52 at each corner of the board; two center court spaces 54 at opposite sides of the center jump circle 14; and two end line spaces 55. A player landing on one of these spaces may make a free choice of which question category to answer.

Referring to FIG. 2, reference numeral 56 designates a miniature basketball goal including a rim and net 58, a backboard 60, and a movable stand 62. A miniature basketball 64 is sized for shooting at the goal. Preferably there is one such goal and basketball for each end of the court.

The SWISH game may be played by several individual players or by teams of players. To start play, each player or team representative rolls the die 30, and the player or team with the highest number begins play. In the event of ties; those tied roll again until the tie is broken. Play begins from one of the Start positions 66 at opposite ends of the court. Initially a basketball goal 56 is positioned at each end of the court just off of the board. The beginning player rolls die 30 and an opposing player at the other end of the court moves the goal 56 in front of him to one of the zones 18 to 28, based on the number rolled on die 30 and the corresponding SWISH number towards the opposing player. For example, if a player starting at the end of the court at the bottom of FIG. 1 rolls a 4; an opposing player would move the goal from behind his court towards the player in action four zones to zone 24. The player in action then attempts a shot at the goal 56 using basketball 64. If the shot is made, 2 points are scored and are recorded on a scoresheet (not shown). In addition, the player's token 32 is moved about the board counterclockwise the number of spaces corresponding to the number previously rolled on the die 30. If the shot is missed, the token is not moved and play passes counterclockwise to the next player.

The basketball goals 56 are mobile, and may be placed aside to facilitate play when not in use. The goals are centered in the court on the appropriate zone line before a shot is attempted.

When a token 32 is moved to the designated space; the indicia on the space indicates which question on a regular season question card 48 is asked. For example, if a player's token lands on a playing space 38, marked "$C_D$"; a question relating to the trivia topic "Central Division" would be asked. The opposing player asks the question from the top card. If the question is answered correctly; the player rolls the die again, and play continues as before with the player attempting to shoot another basket. It is presently preferred that no points be awarded for correct answers.

If the question is not answered correctly; play passes to the next player. Thus in turn each player rolls the die 30, attempts a shot at goal 56, and if the shot is made, moves token 32, and attempts to answer a question determined by the playing space landed upon.

Preferably play is divided into two portions. The first portion, designated as regular season play, is played as specified above for timed quarters, like a real basketball game. The duration of the quarters is set by the players. By way of example, for two players the quarters may be 15 minutes each, and longer for 3 or more players. Scores are tallied at the end of each quarter and the total regular season score of each player or team is recorded.

In the second portion of play, designated playoff, the mode of play is changed. The player or team with the most points from the regular season begins play. In the case of a tie, the die is rolled to break the tie. Play proceeds counterclockwise from player to player. Play begins by rolling the die 30. An opposing player selects the top card from the set 50 of Playoff question and answer cards. These cards have questions and answers numbered from 1 to 6, to correspond to the numbers on die 30. The player attempts to answer the question corresponding to the number rolled. If answered correctly 3 points are scored and the player earns the right to attempt a shot at goal 56 at the opposite end of the court. For a made full court shot, 3 points are scored. If the shot is made, the player continues by rolling the die again etc.

It should be noted that in this mode of play tokens 32 are not used, and the goals 56 stay in areas 68 at the ends of the court. Since all shots are thus long shots; 3 points are awarded, just like for long shots in the real game.

The playoff portion of the game is also played in timed quarters. The winner of the game is the player or team with the highest combined regular season and playoff score.

From the foregoing description it will be apparent that we have provided a novel board game which combines an element of luck, knowledge of basketball, and dexterity or skill in shooting a miniature basketball. The various basketball topics covered by the question categories test the players' knowledge, and the answers may provide information which enhances the players enjoyment of professional and college basketball. It is contemplated that updated questions and answer cards will be made available at intervals to keep the information up to date.

It will be apparent that various changes may be made in the disclosed embodiments of the invention without departing from the scope and spirit of the invention and the appended claims.

We claim:

1. A basketball game apparatus comprising:

a plurality of player tokens, a game board having a plurality of playing spaces forming a pathway for said tokens around said game board, a basketball goal positioned at an end of said game board, a basketball sized for shooting at said goal to enable a player to score points for a made shot, means to determine by chance the number of playing spaces to move said tokens, and at least one set of question cards having basketball related questions to be answered by the players.

2. Apparatus according to claim 1, wherein said question cards each have a plurality of questions and answers, indicia on said question cards identifying the questions, and said playing spaces being marked with corresponding indicia to indicate which question to use upon one of said tokens landing upon one of said playing spaces.

3. Apparatus according to claim 1, further comprising a basketball goal at each of two opposite ends of said game board, said game board having a main section divided into a plurality of zones, said goals being movable into said zones, and chance means to determine in which zone to position a goal in prior to a player attempting a shot at the goal whereby the distance of the shot varies.

4. Apparatus according to claim 3, wherein said chance means comprise said means to determine by chance the number of spaces to move said tokens.

5. Apparatus according to claim 3, wherein said playing spaces are located around the periphery of said game board and enclose said zones.

6. Apparatus according to claim 5, wherein said main section of said game board has markings simulating a basketball court including free throw lanes.

7. Apparatus according to claim 1, further comprising a basketball goal at each of two opposite ends of said game board.

8. Apparatus according to claim 7, wherein said question cards each have a plurality of questions and answers, indicia on said question cards identifying the questions, and said playing spaces being marked with corresponding indicia to indicate which question to use upon one of said tokens landing upon one of said playing spaces.

9. Apparatus accoeding to claim 1, wherein said game board has a main section having markings simulating a basketball court, and said playing spaces being disposed around the periphery of said basketball court.

10. Apparatus according to claim 1, wherein said tokens are configured to simulate a basketball player.

11. A basketball game apparatus comprising:

a game board having markings simulating a basketball court, a basketball goal positioned at each of the opposite ends of said court, at least one basketball for shooting at said goals, a set of question cards having basketball related questions to be answered by the players, indicia on said cards identifying the questions, and chance means having corresponding indicia to indicate which question to use.

* * * * *